US006022468A

United States Patent [19]

Luk et al.

[11] Patent Number: 6,022,468

[45] Date of Patent: Feb. 8, 2000

[54] ELECTROLYTIC HARDENING PROCESS

[76] Inventors: Suet Fan Luk, Room A, 8th Floor, Lido Apartment, 860-878 King's Road, Quarry Bay, Hong Kong; Tin Pui Leung, 11D, 17 Science Museum Road, Tsim Sha Tsui East, Kowloon, Hong Kong, both of The Hong Kong Special Administrative Region of the People's Republic of China; Wah Sing Miu, 7 High Bridge Court, Avonley Village, New Cross, London Se 14 5DB; Ian Robert Pashby, 27 Heritage Court, Gibbet Hill, Coventry CV4 7HD, both of United Kingdom

[21] Appl. No.: 08/967,135

[22] Filed: Nov. 10, 1997

[51] Int. Cl.[7] ..... C21D 1/00

[52] U.S. Cl. ..... 205/704; 205/741

[58] Field of Search ..... 205/704, 741

[56] References Cited

U.S. PATENT DOCUMENTS 4,789,437 12/1988 Sing .

5,795,460 8/1998 Al-Jiboory et al. ..... 204/705

OTHER PUBLICATIONS

Kai–Horng, "Medium–Carbon Steel Surface Hardening by Electrolytic Hardening Method," Taipei Inst. Technolg., Abstract (No Month).

*Primary Examiner*—Arun S. Phasge

*Attorney, Agent, or Firm*—Miller, Sisson, Chapman & Nash, P.C.

[57] ABSTRACT

The method is provided for hardening carbon steel by using electrolysis and a pulsed direct current supply.

13 Claims, 5 Drawing Sheets

ELECTROLYTIC HARDENING PROCESS

The present invention relates to a process for hardening of steel.

BACKGROUND OF THE INVENTION

1. Field of the Invention

The invention relates to hardening of steel.

2. Description of Prior Art

The invention relates more particularly to surface or full hardening of carbon steel. Generally stated it is usual to harden steel or especially outer surfaces of steel or steel members to achieve high hardness and good wear resistance after the member has been formed or shaped as required. Hardened steel surfaces are exceptionally difficult to work (e.g. machine) and so hardening is carried out on a finished or a nearly finished product normally. Hardening is typically carried out by heating the steel member (except for low carbon steel) to a high temperature and quenching the member exceeding its critical cooling rate. Hence the hardening equipment and operating costs are inherently high.

Three Russian papers (Yarsnogorodski, 1954a, b & c) and one Chinese paper (Yan et al, 1994) have proposed hardening of steel by direct current (d.c.) electrolysis in which caterpillar track pins, roller hoops, piston rings, rockers, camshaft, taps and drills were surface hardened. The results were however not stable.

The applications of pulse current in electrodeposition has been described in U.S. Pat. No. 4,789,437 (Miu et al).

SUMMARY OF THE INVENTION

It is an object of the invention to provide an easily operated, environmentally green, and relatively low cost process for hardening steel except low carbon steel.

According to the invention there is provided a method of surface hardening or full hardening a steel member (except not formed of low carbon steel) by electrolysis using a solution of sodium carbonate as electrolyte and comprising applying pulsed direct current.

Preferably, the concentration of sodium carbonate in the electrolyte is from 42 to 176 g/l.

The preferred pulse current ON:OFF ratio is from 6:4 to 9:1 with the most preferred range being 9:1. Preferably, pulse periods are from 0.005 s to 1 s and most preferably 1 s.

Preferably, the average preset voltage is from 220 V to 260 V.

The preferred peak current density is from 200 to 4,500 A/dm$^2$., and most preferably from 340 to 4,500 A/dm$^2$.

The preferred electrolyte temperature is from 10 to 30° C.

During hardening operations, the electrolyte is preferably circulated.

Preferred material for use as an anode are stainless steel sheet and graphite.

The hardening operation of this invention is particularly suitable for members made up of AISI No. 1050 medium-carbon steel, AISI No. 420 medium-carbon alloy steel, and AISI H13 hot work steel.

Particular industrial applications of the process of the present invention are those outlined above and the hardening operations are especially applicable to surface-hardening small high precision components at higher machine efficiency, smaller energy consumption, and safer operation.

This is believed because the same effective case depth can be obtained under pulse current conditions with lower average preset voltage and shorter heating time than that under direct current conditions.

BRIEF DESCRIPTION OF THE DRAWINGS

The invention will now be described by way of example with reference to the accompanying drawings, in which:

FIGS. 11, 12 and 13 show Tables 1, 2 and 3, respectively, heating times against average preset voltages.

DESCRIPTION OF THE PREFERRED EMBODIMENT

The following examples of the invention are described by way of example.

Various tests were performed on workpieces subjected to direct current (d.c.) electrolysis methods and on workpieces subjected to the process of the present invention to evaluate the effectiveness of the present invention which applies pulsed electrolysis.

FIGS. 2 to 5 relate to carrying out the method with an average preset voltage of 240 volts, and a current pulse period of 1 second with an ON/OFF ratio or 9:1.

Figure 1:
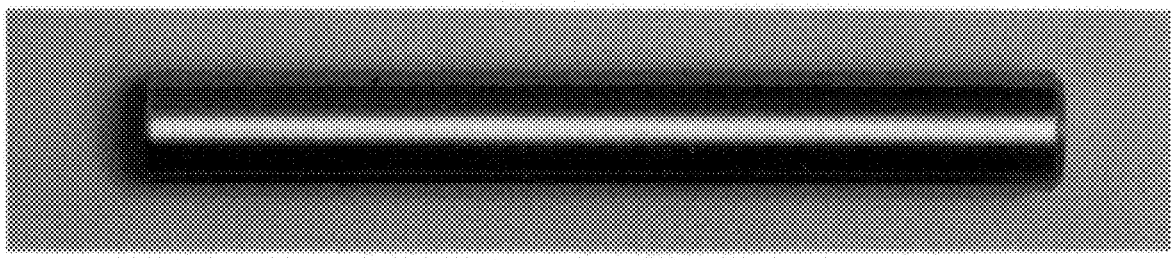
FIG. 1 shows a test workpiece.

In carrying out the method, a sodium carbonate solution is prepared with 45 to 55 g/l of sodium carbonate dissolved in water. The electrolyte is circulated. 8-mm-diameter rod workpieces as shown in FIG. 1 were used as the cathodes. The workpieces are cleaned anodically in an alkaline bath, rinsed, and then acid dipped in a 10% hydrochloric acid solution and rinsed again. The electrolyte temperature ranged from 10 to 35° C. Pulse current is generated by a square-wave pulse rectifier and applied between the workpieces and an anode.

Figure 2:
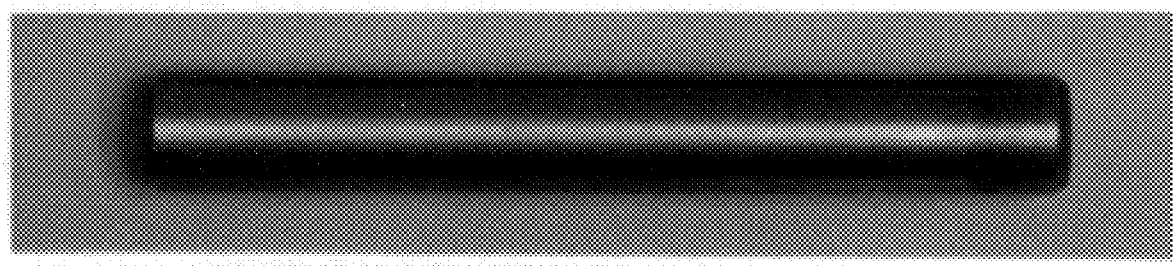
FIG. 2 shows a workpiece obtained after a 5 second surface-hardening operation.
Figure 3:
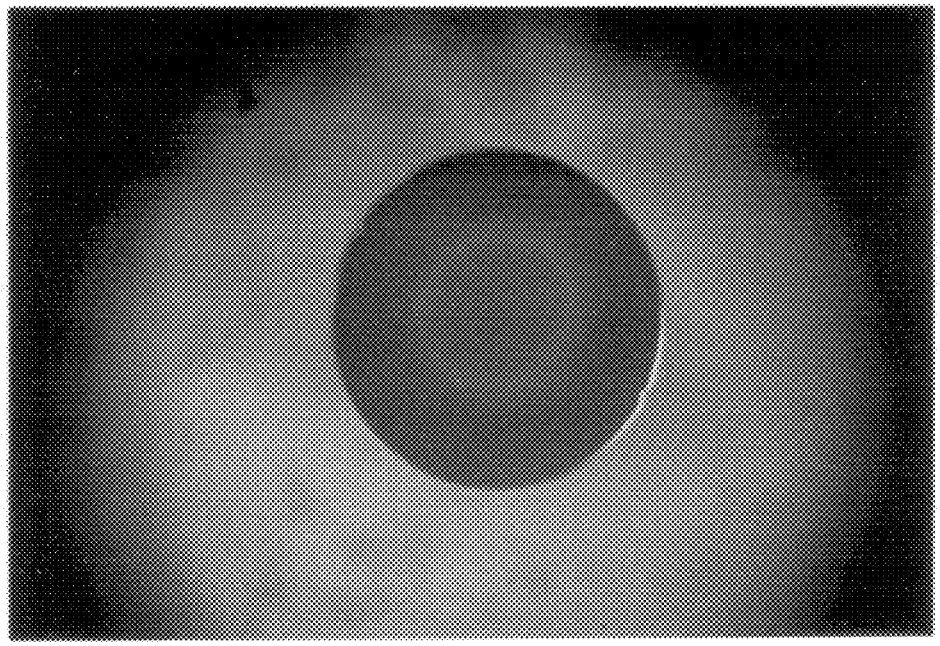
FIG. 3 shows a cross-sectional of the workpiece of FIG. 2.
Figure 4:
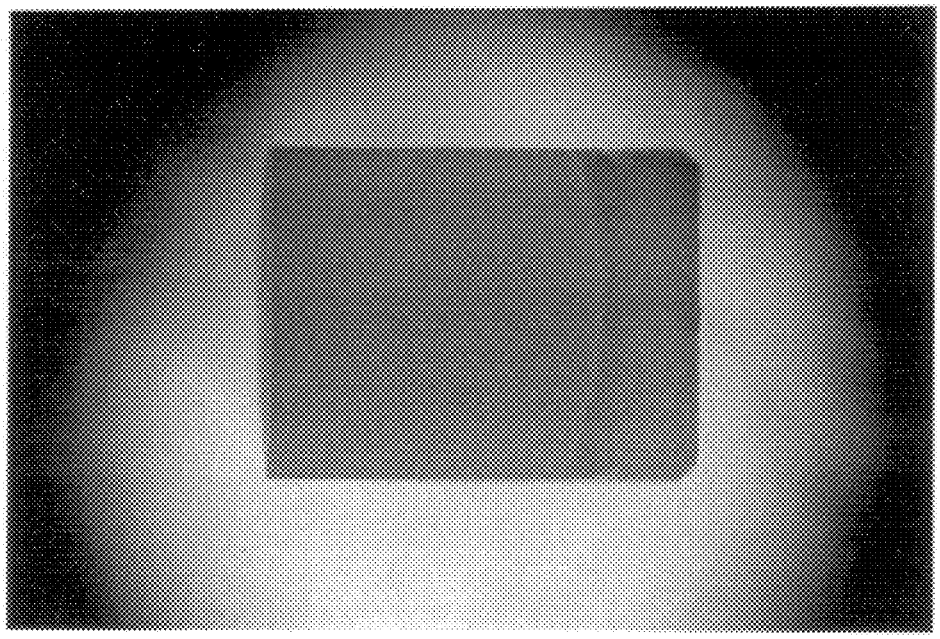
FIG. 4 shows a longitudinal-section of FIG. 2.

FIGS. 2, 3 and 4 show respectively the appearance, the cross-section and longitudinal section of the workpiece after the hardening operation carried out with an average preset voltage of 240 V, a pulse period of 1 second and an ON:OFF ratio of 9:1. The case depth of 1.8 mm.

The surface hardness of the workpiece was determined using a Buehler Rockwell type Macromet I hardness tester.

Figure 5:
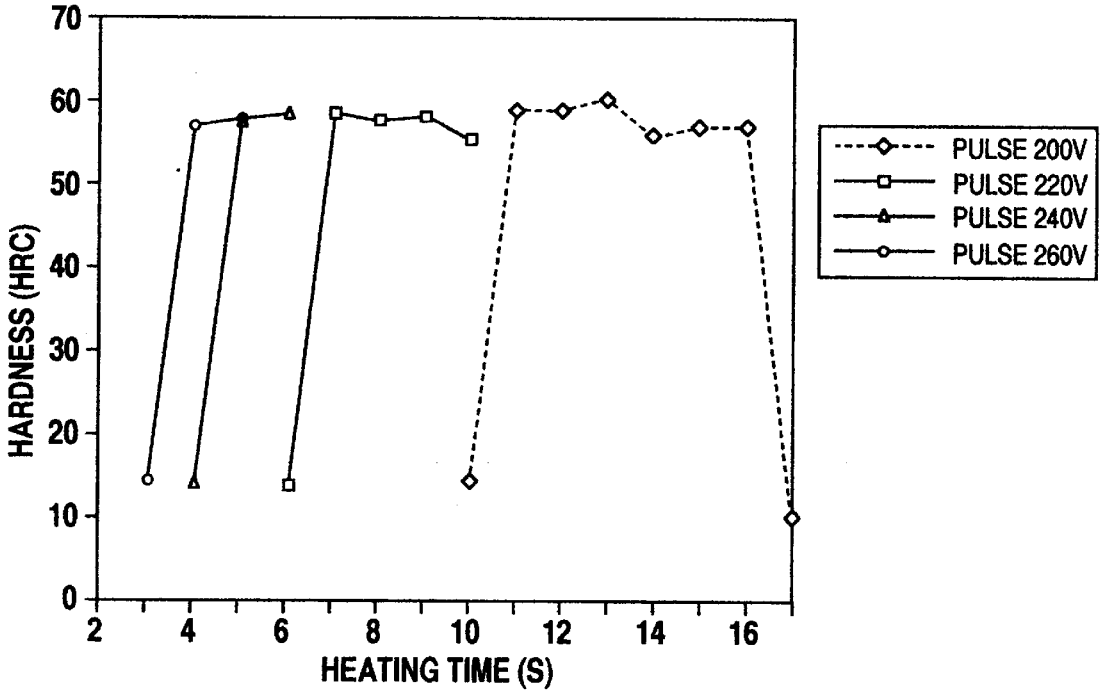
FIG. 5 is a graph of hardness against heating time against different average preset voltages.

Hardness of workpiece against heating time under pulse conditions of the same pulse period of 1 s and ON:OFF ratio of 9:1 but with different average preset voltage of 200 V or above are summarized in Table 1 and plotted as shown in FIG. 5.

Figure 6:
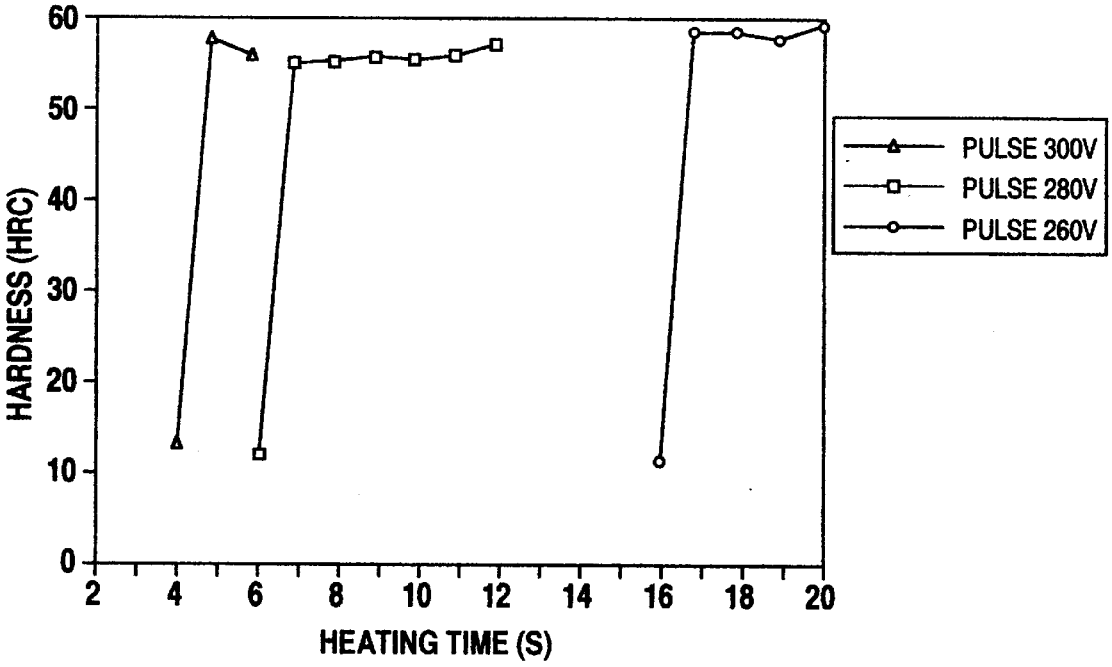
FIG. 6 is a graph of hardness against heating time under d.c. conditions but with different average preset voltages.

Hardness of workpiece against heating time under d.c. conditions but with different average preset voltage of 260 V or above are summarized in Table 2 and plotted as shown in FIG. 6.

The original hardness of the workpiece was below 20 HRC. In the prior art method if the workpiece is heated to its austenitizing temperature and quenched exceeding the critical cooling rate, the workpiece will harden. The hardness of hardened workpiece will be found to be above 53 HRC (about 550 HV). As illustrated at average preset voltages of 280 V and 300 V, the ranges of heating time which are capable of hardening the workpiece before melting are less than 1 s, which is too short in practice to be operated and controlled. Hence, the pulse conditions of average preset voltages of 280 V and 300 V at a pulse period of 1 s and an ON:OFF ratio of 9:1 are not normally recommended for usual applications.

The hardening performance as shown under pulse conditions of a pulse period of 1 s and an ON:OFF ratio of 9:1 is not stable at an average preset voltage of 200 V since some workpieces may not harden after heating for 17 s but some harden at 16 s or less. Hence, the pulse condition of an average preset voltage of 200 V at a pulse period of 1 s and an ON:OFF ratio of 9:1 are not usually acceptable in practice.

The following ranges of heating times under pulse conditions of a pulse period of 1 s and an ON:OFF ratio of 9:1 are recommended:

(1) from 7 s to 10 s at an average preset voltage of 220;

(2) from 5 s to 6 s at an average preset voltage of 240; and (3) from 4 s to 5 s at an average preset voltage of 260.

As further illustrated in Table 2 and FIG. 6, the following ranges of heating time under d.c. conditions are capable of hardening the workpiece as below:

(1) from 17 s to 20 s at an average preset voltage of 260;

(2) from 7 s to 12 s at an average preset voltage of 280; and (3) from 5 s to 6 s at an average preset voltage of 300.

As the average preset voltage is increased, the heating time required to harden the workpiece is decreased. However, beyond the above range of heating time, the surface of the workpiece is heated to a degree sufficient to cause melting, which is not acceptable. Under the pulse conditions of a pulse period of 1 s and an ON:OFF ratio of 9:1, the minimum heating time required to harden the workpiece is 4 s while that under the d.c. conditions is 17 s at the same average voltage of 260 V, for example.

Since the effective area of workpiece or cathode immersed in the electrolyte is 1.76 $cm^2$. The peak current density is ranged from 57 to 1,648 $A/dm^2$.

Hardened workpieces in the above-recommended range of heating time and average preset voltage were sectioned to measure Vickers hardness using Shimadzu micro-hardness tester (type M) in order to determine the effective case depth of the specimen from the surface at which the hardness is 550 HV. The effective case depth against heating time under pulse conditions of the same pulse period of 1 s and ON:OFF ratio of 9:1, and also d.c. conditions but with different average preset voltages is summarized in Table 3 and plotted as shown in FIG. 7.

Figure 7:
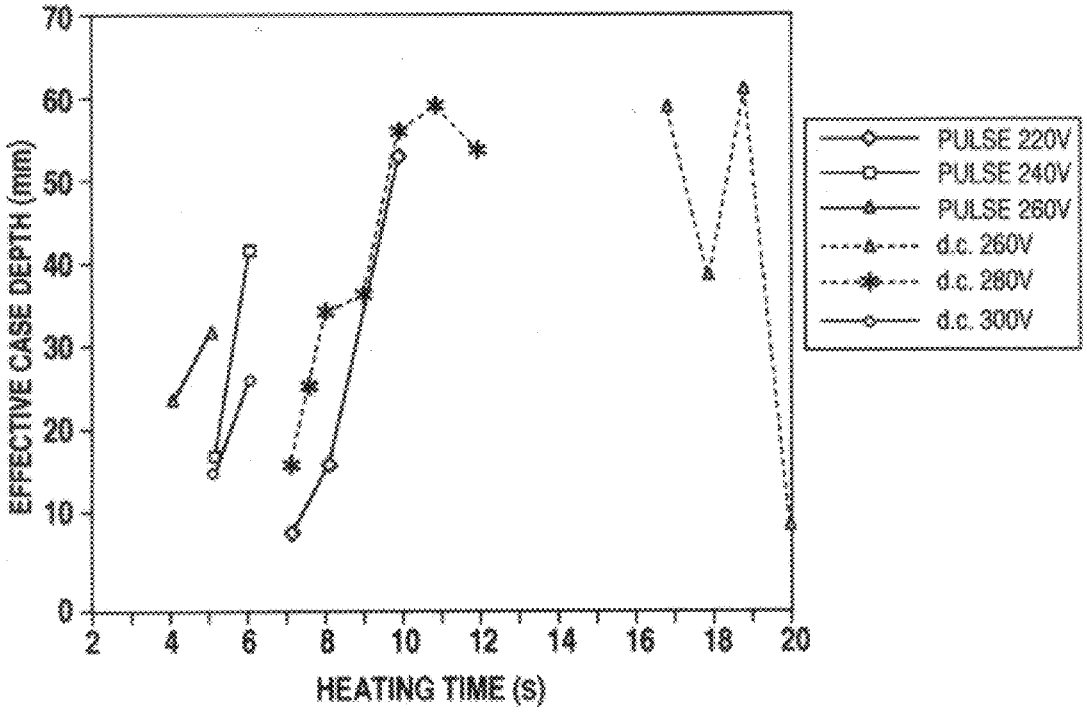
FIG. 7 is a graph of effective case depth against heating time under pulse conditions and also d.c. conditions but with different average preset voltages.

As illustrated in FIG. 7, the case depths obtained under d.c. conditions are not stable at average preset voltages of 260 V and 280 V since some specimens were found to have smaller case depth after heating for longer time. Workpieces hardened under the following ranges of heating time and using pulse conditions of a pulse period of 1 s and an ON:OFF ratio of 9:1, and d.c. condition at each average preset voltage are acceptable:

(1) from 4 s to 5 s pulsed at an average preset voltage of 260;

(2) from 5 s to 6 s pulsed at an average preset voltage of 240; and (3) from 7 s to 10 s pulsed at an average preset voltage of 220; and (4) from 5 s to 6 s using non-pulsed d.c. at average preset voltage of 300.

Comparing those results above, if the case depth requirement is 0.5 mm, the minimum average preset voltage under pulse conditions of a pulse period of 1 s and an ON:OFF ratio of 9:1 is 220 V, while that under d.c. conditions is 300 V. Lower voltage implies safer operation. Furthermore, if the case depth requirement is 0.5 mm, the minimum heating time under pulse conditions of an average preset voltage of 260 V, a pulse period of 1 s and an ON:OFF ratio of 9:1 is 4 s, while that under d.c. condition of 300 V is 5 s. This implies a 25% increase in machine efficiency.

The above data shows that for the same case depth, the heating time and the average preset voltage required under pulse conditions are shorter and lower than that under d.c. conditions, respectively. The machine efficiency will be higher and the energy consumption will be less.

Further, it is noted that since the depth of workpiece immersed in the electrolyte is 5 mm, if the case depth of the specimen obtained is beyond 5 mm, e.g. heating for 10 s under pulse conditions of a pulse period of 1 s and an ON:OFF ratio of 9:1 with an average preset voltage of 220 V, the workpiece will fully-harden. Other specimens having a smaller case depth will surface-harden only.

Figure 8:
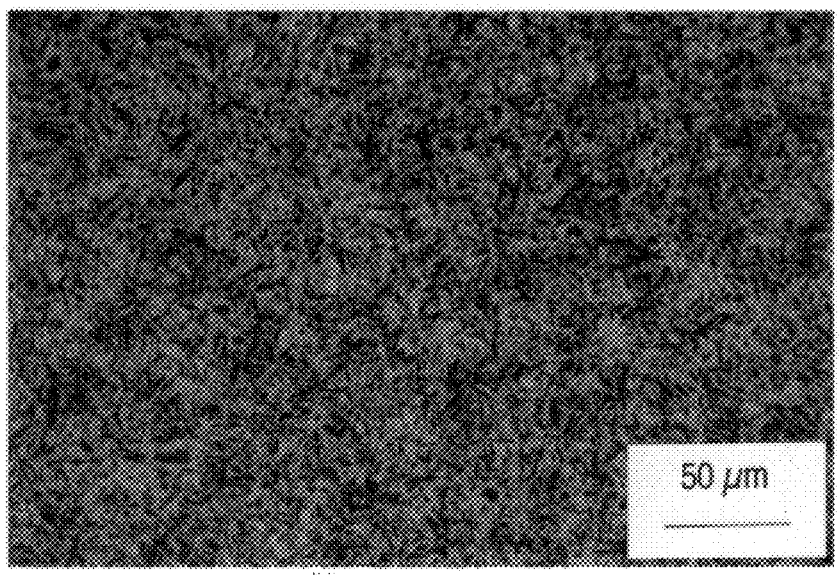
FIG. 8 is a photomicrograph showing the martensite structure in the hardened zone of a typical hardened specimen etched in 2% nital.
Figure 9:
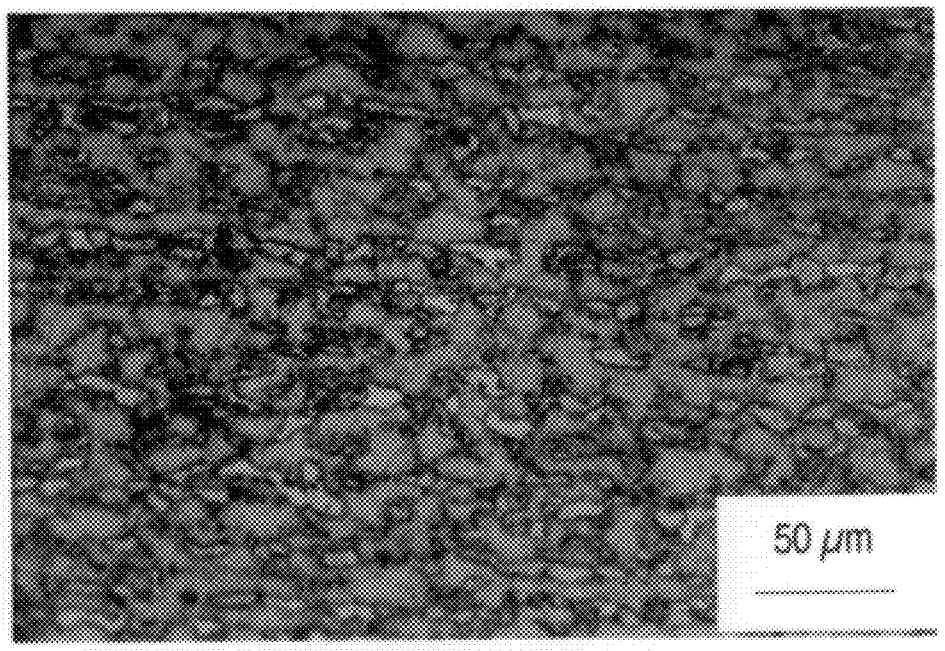
FIG. 9 is a photomicrograph showing martensite (grey areas) and ferrite (white areas) in the transition zone of a typical hardened specimen etched in 2% nital.
Figure 10:
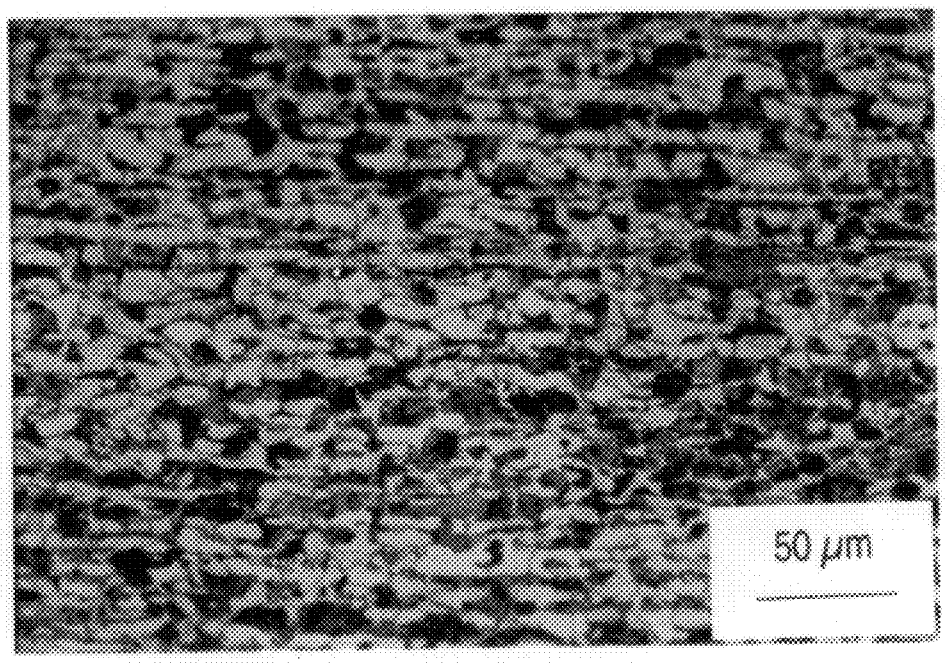
FIG. 10 is a photomicrograph showing pearlite (dark areas) and ferrite (light areas) in the original material of a typical specimen etched in 2% nital.

Microscopic examination carried out on sectioned specimens is provided. Typical hardened area, the transition zone and the original material are shown in FIGS. 8, 9 and 10 respectively. The structure of the typical hardened area is shown in FIG. 8 and has been found to be martensite. The structure of the transition zone as shown in FIG. 9 is martensite (grey areas) and ferrite (white areas). The structure of the original material as shown in FIG. 10 have been verified to be pearlite (dark areas) and ferrite (light areas).

We claim:

1. A method of hardening a steel member not having a low carbon composition comprising the steps of:

placing said steel member into a solution of sodium carbonate electrolyte and applying a pulsed electric current to said steel member.

2. A method according to claim 1, in which the sodium carbonate solution has a concentration in the range 40 to 430 g/l.

3. A method according to claim 1, in which the concentration is in the range 42 to 176 g/l.

4. A method according to claim 1, in which the pulse current has an ON/OFF ratio between 1:9 and 9:1.

5. A method according to claim 4, in which ON/OFF ratio is betwen 6:4 and 9:1.

6. A method according to claim 4, in which the current pulse period is in the range 0.005 to 1.0 seconds.

7. A method according to claim 6, in which the current pulse period is 1.0 second.

8. A method according to claim 1, in which the pulsed direct current has an average preset voltage in the range of 200 to 300 volts.

9. A method according to claim 8, in which the average present voltage is in the range 220 to 260 volts.

10. A method according to claim 1, in which the pulsed current has a peak current density in the range of 57 to 4500 $A/dm^2$.

11. A method according to claim 10, in which the current density is greater than 340 $A/dm^2$.

12. A method according to claim 1, in which the electrolyte is controlled to be at a temperature between 10 to 30° C.

13. A method according to claim 1, including circulating the electrolyte when carrying out the method.

* * * * *